US005819753A

United States Patent [19]

Birkenthal

[11] Patent Number: 5,819,753

[45] Date of Patent: Oct. 13, 1998

[54] DEVICE FOR SEVERING A PORTION OF A CIGARETTE

[76] Inventor: Eddie A. Birkenthal, 5225 East Georgia Street, Burnaby, Canada, V5B 1V3

[21] Appl. No.: 936,946

[22] Filed: Sep. 25, 1997

[51] Int. Cl.[6] ..... A24F 13/24

[52] U.S. Cl. ..... 131/248; 131/249

[58] Field of Search ..... 131/248, 249, 131/250; 30/113, 112

[56] References Cited

U.S. PATENT DOCUMENTS

| | | | |
|---|---|---|---|
| 282,764 | 8/1883 | Peavey | 131/248 |
| 317,980 | 5/1885 | Dixox | 131/249 |
| 911,804 | 2/1909 | Barton | 131/249 |
| 5,664,331 | 9/1997 | Yu | 30/113 |
| 5,694,691 | 12/1997 | Chen | 30/112 |

*Primary Examiner*—John G. Weiss
*Assistant Examiner*—Charles W. Anderson

[57] ABSTRACT

A cigarette severing device is provided including a housing with a slot and a circular aperture formed therein. A blade is slidably situated within the slot. Also included is a slider control mechanism for effecting the sliding of the blade within the slot. As such, a user may move the blade within the slot by way of the slider control mechanism for severing a cigarette situated within the circular aperture. Next provided is a mechanism for drawing the blade tightly against one of the faces of the housing only when the blade enters the circular aperture to effect a clean cut.

6 Claims, 2 Drawing Sheets

DEVICE FOR SEVERING A PORTION OF A CIGARETTE

BACKGROUND OF THE INVENTION

1. Field of the Invention

The present invention relates to cigar cutters and more particularly pertains to a new device for severing a portion of a cigarette for cleanly cutting an end from a cigarette.

2. Description of the Prior Art

The use of cigar cutters is known in the prior art. More specifically, cigar cutters heretofore devised and utilized are known to consist basically of familiar, expected and obvious structural configurations, notwithstanding the myriad of designs encompassed by the crowded prior art which have been developed for the fulfillment of countless objectives and requirements.

Known prior art cigar cutters include U.S. Pat. No. 5,303,721; U.S. Pat. Des. 244, 390; U.S. Pat. No. 4,027,682; U.S. Pat. No. 5,181,528; and U.S. Pat. No. 5,345,952.

In these respects, the device for severing a portion of a cigarette according to the present invention substantially departs from the conventional concepts and designs of the prior art, and in so doing provides an apparatus primarily developed for the purpose of cleanly cutting an end from a cigarette.

SUMMARY OF THE INVENTION

In view of the foregoing disadvantages inherent in the known types of cigar cutters now present in the prior art, the present invention provides a new device for severing a portion of a cigarette construction wherein the same can be utilized for cleanly cutting an end from a cigarette.

The general purpose of the present invention, which will be described subsequently in greater detail, is to provide a new device for severing a portion of a cigarette apparatus and method which has many of the advantages of the cigar cutters mentioned heretofore and many novel features that result in a new device for severing a portion of a cigarette which is not anticipated, rendered obvious, suggested, or even implied by any of the prior art cigar cutters, either alone or in any combination thereof.

To attain this, the present invention generally comprises a housing having a rectangular configuration with a first rectangular face, a second rectangular face and a generally rectangular periphery having rounded corners. As shown in the Figures, the periphery is defined by an upper edge, a lower edge, and a pair of end edges. The housing has a first elongated slot formed within the housing. Such first elongated slot is defined by a top and bottom linear edge situated in parallel with the upper edge and lower edge of the housing, a linear end edge, and an arcuate end edge. The housing further has a second slot formed therein which resides in communication between the first slot and the first rectangular face of the housing. The second elongated slot has a length less than that of the first elongated slot and a width less than that of the first elongated slot. It should be noted that the second elongated slot is centered with respect to the first slot. The housing further includes a circular aperture with a diameter of ⅜ inch formed between the first and second rectangular face of the housing. Such circular apertures are further positioned between an end of the second elongated slot and the arcuate edge of the first elongated slot. The circular aperture resides in communication with the first elongated slot and has a diameter less than the width of the first elongated slot. As best shown in FIGS. 3 & 4, a blade is provided having a thin rectangular configuration with a top and bottom linear edge, a linear end edge, and an arcuate end edge. The blade has a width equal to that of the first elongated slot and a length less than that of the first elongated slot of the housing. During use, the blade is slidably situated within the first elongated slot. Finally, a slider control mechanism is provided including an elongated tab with a generally rectangular configuration. The elongated tab has a smooth planar rear face and a front face with a plurality of undulations formed therein. As shown in FIGS. 1 & 2, the front face of the elongated tab is equipped with a first planar extent and a second beveled extent. The tab further has a width greater than that of the second elongated slot and less than that of the first elongated slot. The slider control mechanism further includes an interconnect member taking the form of a post with an oval cross-section integrally coupled to the smooth planar rear face of the elongated tab. A second end of the interconnect member is fixedly coupled within an oval bore formed in the blade adjacent the linear end edge thereof. As such, a user may move the blade within the first elongated slot by way of the elongated tab of the slider control mechanism for severing a cigarette situated within the circular aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for severing a portion of a cigarette apparatus and method which has many of the advantages of the cigar cutters mentioned heretofore and many novel features that result in a new device for severing a portion of a cigarette which is not anticipated, rendered obvious, suggested, or even implied by any of the prior art cigar cutters, either alone or in any combination thereof.

It is another object of the present invention to provide a new device for severing a portion of a cigarette which may be easily and efficiently manufactured and marketed.

It is a further object of the present invention to provide a new device for severing a portion of a cigarette which is of a durable and reliable construction.

An even further object of the present invention is to provide a new device for severing a portion of a cigarette which is susceptible of a low cost of manufacture with regard to both materials and labor, and which accordingly is then susceptible of low prices of sale to the consuming public, thereby making such device for severing a portion of a cigarette economically available to the buying public.

Still yet another object of the present invention is to provide a new device for severing a portion of a cigarette which provides in the apparatuses and methods of the prior art some of the advantages thereof, while simultaneously overcoming some of the disadvantages normally associated therewith.

Still another object of the present invention is to provide a new device for severing a portion of a cigarette for cleanly cutting an end from a cigarette.

Even still another object of the present invention is to provide a new device for severing a portion of a cigarette that includes a housing with a slot and a circular aperture formed therein. A blade is slidably situated within the slot. Also included is a slider control mechanism for effecting the sliding of the blade within the slot. As such, a user may move the blade within the slot by way of the slider control mechanism for severing a cigarette situated within the circular aperture. Next provided is a mechanism for drawing the blade tightly against one of the faces of the housing only when the blade enters the circular aperture to effect a clean cut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
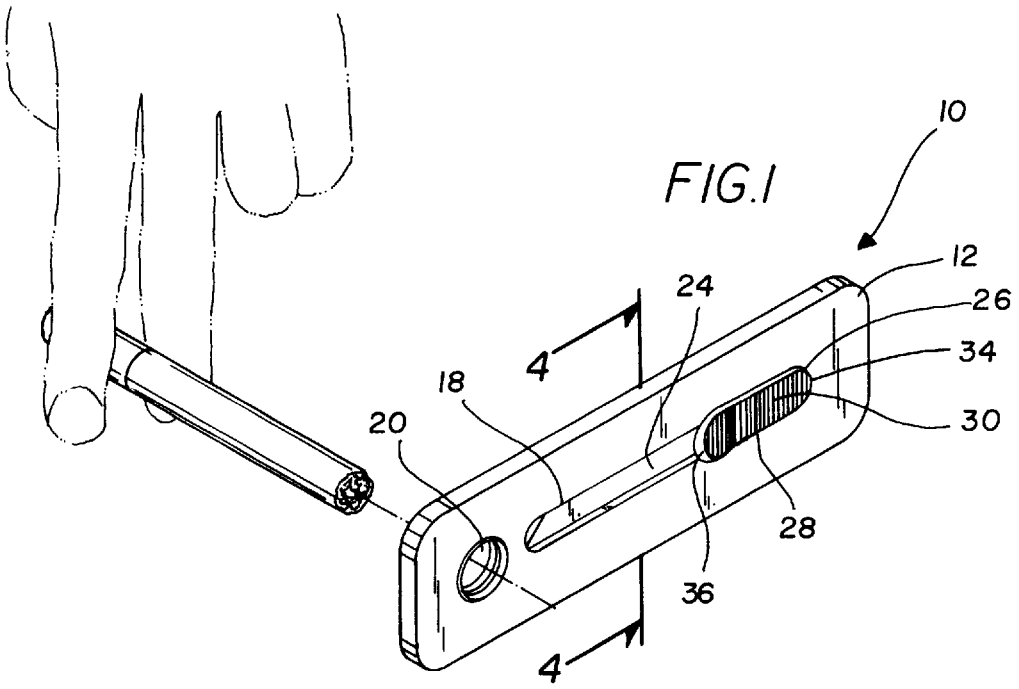
FIG. 1 is a perspective view of a new device for severing a portion of a cigarette according to the present invention.

With reference now to the drawings, and in particular to FIGS. 1 through 4 thereof, a new device for severing a portion of a cigarette embodying the principles and concepts of the present invention and generally designated by the reference numeral 10 will be described.

The present invention, as designated as numeral 10, includes a housing 12 having a rectangular configuration with a first rectangular face, a second rectangular face and a generally rectangular periphery having rounded corners. As shown in the Figures, the periphery is defined by an upper edge, a lower edge, and a pair of end edges. Ideally, the housing has a length of about 3 and ½ inches, a thickness of about ¼ of an inch, and a width of 1 inch. Also, the housing is ideally constructed from a heat resistant plastic. The housing has a first elongated slot 14 formed within the housing. Such first elongated slot is defined by a top and bottom linear edge situated in parallel with the upper edge and lower edge of the housing, a linear end edge, and an arcuate end edge 16.

The housing further has a second slot 18 formed therein which resides in communication between the first slot and the first rectangular face of the housing. The second elongated slot has a length less than that of the first elongated slot and a width less than that of the first elongated slot. It should be noted that the second elongated slot is centered with respect to the first slot. Preferably, the first elongated slot is completely encompassed by the housing with the exception of the second elongated slot.

Figure 2:
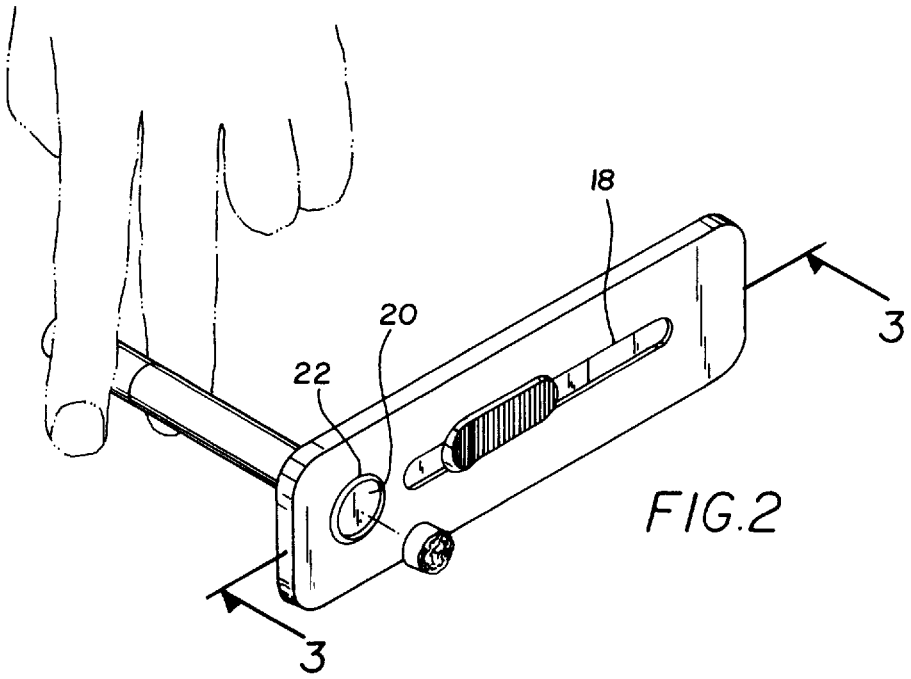
FIG. 2 is a perspective view of the present invention in use.
Figure 4:
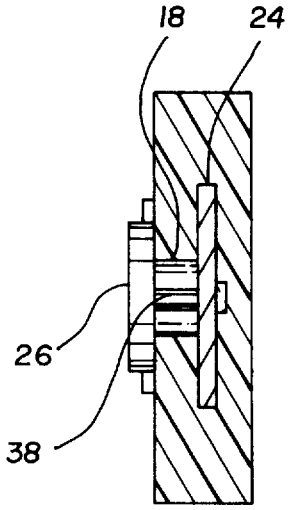
FIG. 4 is a cross-sectional view of the present invention taken along line 4—4 shown in FIG. 1.

The housing further includes a circular aperture 20 with a diameter of ⅜ inch formed between the first and second rectangular face of the housing. The specific diameter of the circular aperture is specifically tailored for cigarette use. Such circular apertures are further positioned between an end of the second elongated slot and the arcuate edge of the first elongated slot. The circular aperture resides in communication with the first elongated slot and has a diameter less than the width of the first elongated slot. As shown in FIGS. 1, 2 & 4, the circular aperture preferably has a pair of annular extensions 22 integrally coupled to the faces of the housing about a periphery of the circular aperture and extending outwardly therefrom. Each annular extension has an outer diameter of 9/16 of an inch.

Figure 3:
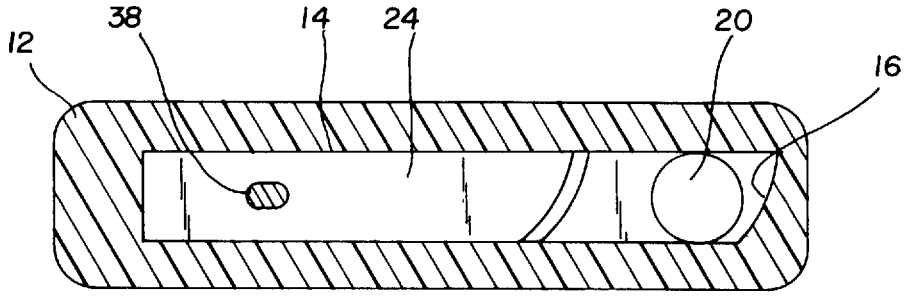
FIG. 3 is a cross-sectional view of the present invention taken along line 3—3 shown in FIG. 2.

As best shown in FIGS. 3 & 4, a blade 24 is provided having a thin rectangular configuration with a top and bottom linear edge, a linear end edge, and an arcuate end edge. Such arcuate edge is sharpened and depends toward the linear end edge from the top linear edge to the bottom linear edge. The blade has a width equal to that of the first elongated slot and a length less than that of the first elongated slot of the housing. During use, the blade is slidably situated within such first elongated slot. In the preferred embodiment, the blade has a length of about ¾ that of the first elongated slot of the housing.

Finally, a slider control mechanism 26 is provided including an elongated tab 28 with a generally rectangular configuration. The elongated tab has a smooth planar rear face and a front face with a plurality of undulations 30 formed therein. As shown in FIGS. 1 & 2, the front face of the elongated tab 32 is equipped with a first planar extent 34 and a second beveled extent 36. The tab further has a width greater than that of the second elongated slot and less than that of the first elongated slot.

The slider control mechanism further includes an interconnect member 38 taking the form of a post with an oval cross-section integrally coupled to the smooth planar rear face of the elongated tab. A second end of the interconnect member is fixedly coupled within an oval bore formed in the blade adjacent the linear end edge thereof. Such coupling is designed to prevent the elongated tab from rotating. As such, a user may move the blade within the first elongated slot by way of the elongated tab of the slider control mechanism for severing a cigarette situated within the circular aperture.

In the preferred embodiment, the leading edge elongated tab and sharp edge of the blade have a relative position such that upon the entering of the sharp edge within the circular aperture, a leading edge of the elongated tab rides up upon the annular extensions for pulling the blade tight against one of the faces of the housing for affording a clean cut. The elongated tab and annular extensions thus function as means for drawing the blade tightly against one of the faces of the housing only when the blade enters the circular aperture. To facilitate the engagement of the annular extensions and elongated tab, the rear face of the elongated tab preferably has a leading beveled extent.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cigarette severing device comprising, in combination:

a housing having a rectangular configuration with a first rectangular face, a second rectangular face and a generally rectangular periphery having rounded corners defined by an upper edge, a lower edge, and a pair of end edges, the housing having a first elongated slot formed within the housing with a top and bottom linear edge situated in parallel with the upper edge and lower edge of the housing, a linear end edge, and an arcuate end edge, the housing further having a second slot formed therein in communication between the first slot and the first rectangular face of the housing, the second elongated slot having a length less than that of the first elongated slot and a width less than that of the first elongated slot wherein the second elongated slot is centered with respect to the first slot, the housing further including a circular aperture with a diameter of ⅜ inch formed between the first and second rectangular face of the housing between an end of the second elongated slot and the arcuate edge of the first elongated slot, wherein the circular aperture is in communication with the first elongated slot and has a diameter less than the width of the first elongated slot, the circular aperture having a pair of annular extensions integrally coupled to the housing about a periphery of the circular aperture and extending outwardly therefrom with an outer diameter of 9/16 of an inch, wherein the housing has a length of 3 and ½ inches, a thickness of ¼ of an inch, and a width of 1 inch, the housing being constructed from a heat resistant plastic;

a blade having a thin rectangular configuration with a top and bottom linear edge, a linear end edge, and an arcuate end edge, wherein the blade has a width equal to that of the first elongated slot and a length less than that of the first elongated slot of the housing, the blade slidably situated within the first elongated slot, wherein the blade has a length of about ¾ that of the first elongated slot of the housing;

a slider control mechanism including an elongated tab with a generally rectangular configuration having a smooth planar rear face and a front face with a plurality of undulations formed therein and a first planar extent and a second beveled extent, the tab having a width greater than that of the second elongated slot and less than that of the first elongated slot, the slider control mechanism further including an interconnect member taking the form of a post with an oval cross-section integrally coupled to the smooth planar rear face of the elongated tab and a second end fixedly coupled within an oval bore formed in the blade adjacent the linear end edge thereof, whereby a user may move the blade within the first elongated slot by way of the elongated tab of the slider control mechanism for severing a cigarette situated within the circular aperture; and wherein a leading edge of the elongated tab and a sharp edge of the blade have a relative position such that upon the entering of the sharp edge within the circular aperture, the leading edge of the elongated tab rides up upon the annular extensions for pulling the blade tight against one of the faces of the housing for affording a clean cut, the rear face of the tab having a leading beveled extent.

2. A cigarette severing device comprising:

a housing with a slot and an aperture formed therein and a protrusion formed adjacent the aperture and extending outwardly therefrom;

a blade slidably situated within the slot; and a slider control mechanism for effecting the sliding of the blade within the slot, whereby a user may move the blade within the slot by way of the slider control mechanism for severing a cigarette situated within the circular aperture;

wherein the slider control mechanism rides upon the protrusion for drawing the blade tightly against a face of the housing when the blade enters the aperture.

3. A cigarette severing device as set forth in claim 2 wherein the slider control mechanism includes an elongated tab and an interconnect member having a first end integrally coupled to a rear face of the elongated tab and a second end fixedly coupled within a bore formed in the blade.

4. A cigarette severing device as set forth in claim 3 wherein the interconnect member takes the form of a post with an oval cross-section.

5. A cigarette severing device as set forth in claim 3 wherein the elongated tab includes having a smooth planar rear face and a front face with a plurality of undulations formed therein.

6. A cigarette severing device as set forth in claim 3 wherein a front face of the elongated tab includes a first planar extent and a second beveled extent.

* * * * *